US011118389B2

(12) United States Patent
Kashiwaguma et al.

(10) Patent No.: US 11,118,389 B2
(45) Date of Patent: Sep. 14, 2021

(54) RETRACTING DEVICE AND RETRACTING DEVICE SET

(71) Applicant: SUGATSUNE KOGYO CO., LTD., Tokyo (JP)

(72) Inventors: Kazuaki Kashiwaguma, Tokyo (JP); Shuu Shimizu, Tokyo (JP); Naoya Iwata, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 17/040,466

(22) PCT Filed: Feb. 15, 2019

(86) PCT No.: PCT/JP2019/005521
§ 371 (c)(1),
(2) Date: Sep. 22, 2020

(87) PCT Pub. No.: WO2019/181303
PCT Pub. Date: Sep. 26, 2019

(65) Prior Publication Data

US 2021/0025209 A1 Jan. 28, 2021

(30) Foreign Application Priority Data

Mar. 23, 2018 (JP) ..... JP2018-055484

(51) Int. Cl.
*E05F 5/06* (2006.01)
*E05F 5/02* (2006.01)

(52) U.S. Cl.
CPC ..... *E05F 5/027* (2013.01); *E05Y 2201/21* (2013.01); *E05Y 2201/488* (2013.01); *E05Y 2900/132* (2013.01)

(58) Field of Classification Search
CPC ..... E05C 17/00; E05C 17/46; E05C 17/54; E05C 17/44; E05C 17/025; E05F 5/02;
(Continued)

(56) References Cited

U.S. PATENT DOCUMENTS 2,028,424 A * 1/1936 Van Dillen ..... E05F 1/1008 292/78
2,722,443 A * 11/1955 Falk ..... E05F 5/027 292/79

(Continued)

FOREIGN PATENT DOCUMENTS

EP 3032018 A1 6/2016
JP 10220091 A * 8/1998 ..... E05C 19/022

(Continued)

OTHER PUBLICATIONS

International Search Report dated Mar. 26, 2019 in International Application No. PCT/JP2019/005521, 2 pages.

*Primary Examiner* — Chuck Y Mah
(74) *Attorney, Agent, or Firm* — Masuvalley & Partners

(57) ABSTRACT

Provided is a retracting device comprising a main arm and a sub-arm wherein appearance can be improved. An arm (5) has a main arm (7) and a sub-arm (8) such that an acceptance portion (25) for accepting a receiving part (reception part) (6) is formed between these. The main arm (7) and the sub-arm (8) are configured so that the main arm (7) and the sub-arm (8) rotate by way of: the acceptance portion (25) being closed in a hold position; the acceptance portion (25) opening by the receiving part (reception part) (6) coming into contact with the main arm (7) in the hold position; and an end portion (21) of the main arm (7) and an end portion (24) of the sub-arm (8) coming into contact while the acceptance portion (25) is opened.

5 Claims, 15 Drawing Sheets

(58) Field of Classification Search
CPC ..... E05F 5/027; E05F 5/06; E05F 5/08; E05F 5/18; E05F 5/00; E05Y 2900/132; E05Y 2201/21; E05Y 2201/212; E05Y 2201/224; E05Y 2201/246; E05Y 2201/266; E05Y 2201/484; E05Y 2201/488; Y10T 292/71; Y10T 292/73; Y10T 16/61; Y10T 16/625
See application file for complete search history.

(56) References Cited

U.S. PATENT DOCUMENTS 2,728,596 A * 12/1955 Curtiss, Jr. ..... E05B 65/0046 292/332
2,777,722 A * 1/1957 Burke ..... E05B 65/0046 292/332
3,506,292 A * 4/1970 Hagendoorn ..... E05C 19/024 292/78
3,659,886 A * 5/1972 Andrews ..... E05C 19/024 292/78
5,560,079 A * 10/1996 Jeynes ..... E05F 5/027 16/80
9,267,315 B2 * 2/2016 Lee ..... E05B 65/0053
10,184,282 B2 * 1/2019 Oplatek ..... E05C 5/00
2005/0005397 A1 * 1/2005 Gomoll ..... E05F 5/027 16/286
2011/0254292 A1 * 10/2011 Ishii ..... E05F 5/027 292/341.15
2012/0317883 A1 * 12/2012 Yamaguchi ..... E05F 3/106 49/358
2019/0374047 A1 * 12/2019 Nishiyama ..... A47F 3/04

FOREIGN PATENT DOCUMENTS

JP 2004-137821 A 5/2004
JP 2007-177459 A 7/2007
JP 2009185467 A * 8/2009 ..... E05F 1/1066
JP 4951582 B2 6/2012
JP 2012-251367 A 12/2012
JP 5726456 B2 6/2015
JP 2015-124601 A 7/2015
JP 2016-198693 A 12/2016
KR 101500865 B1 * 3/2015
WO 2007-055204 A1 5/2007
WO WO-2010092734 A1 * 8/2010 ..... E05F 1/1066

* cited by examiner

[Fig. 1]
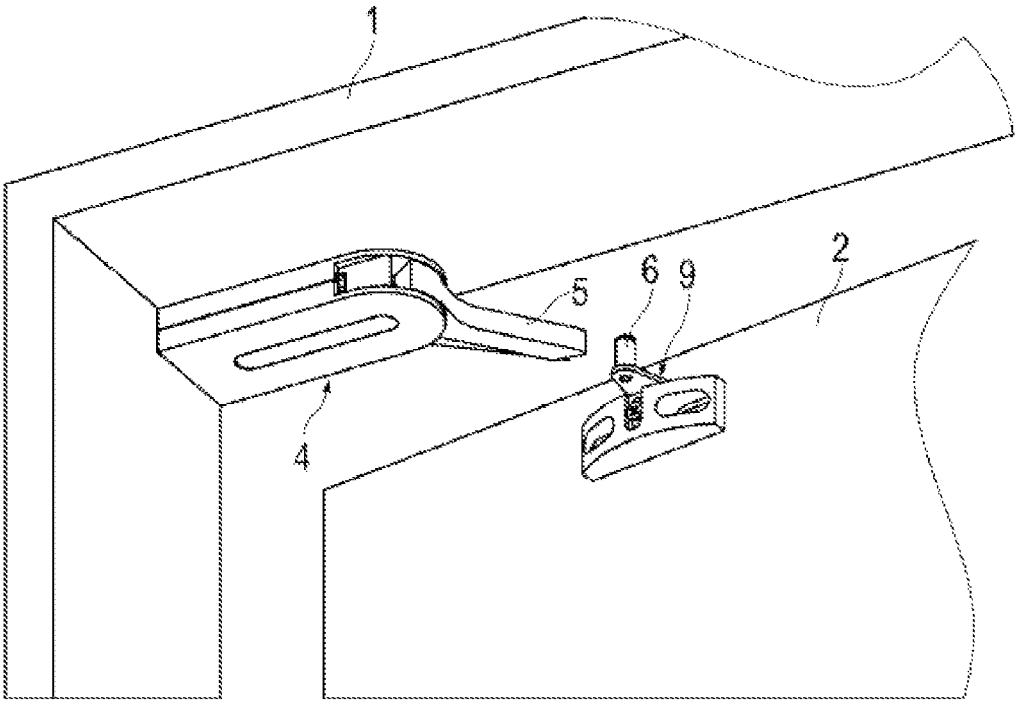

[Fig. 2]
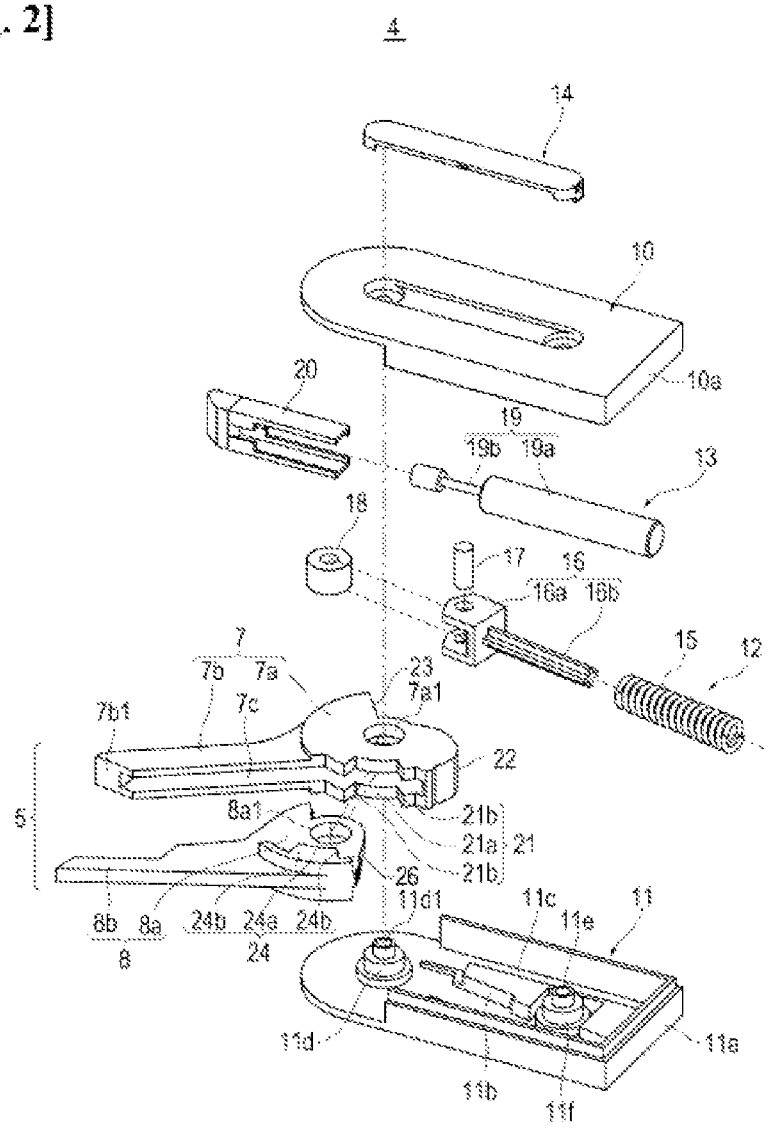

[Fig. 3]
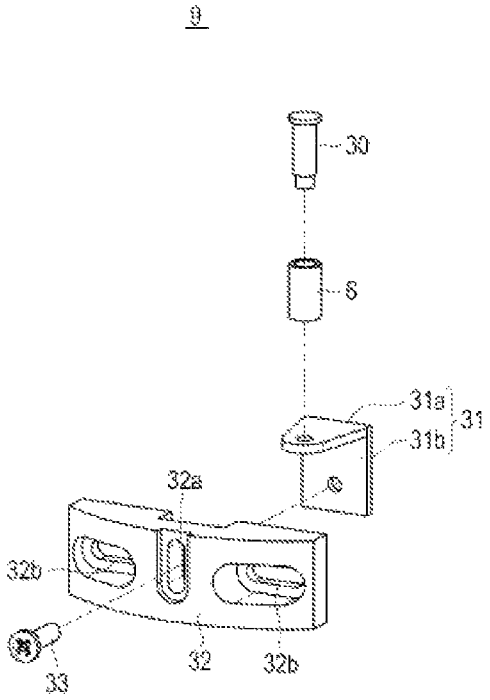

[Fig. 4]
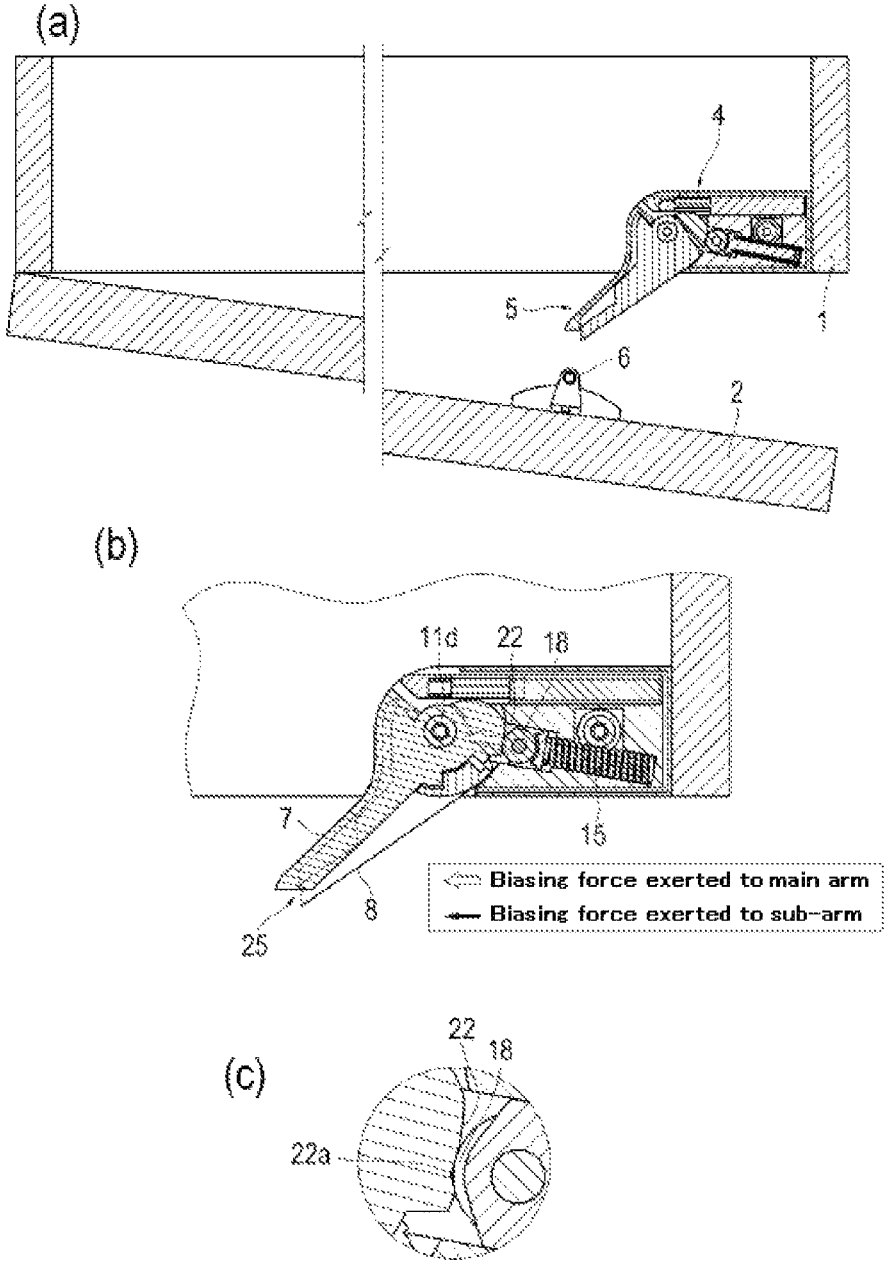

[Fig. 5]
(a)
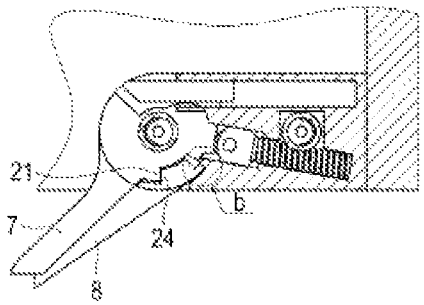
(b)
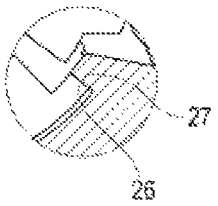

[Fig. 6]
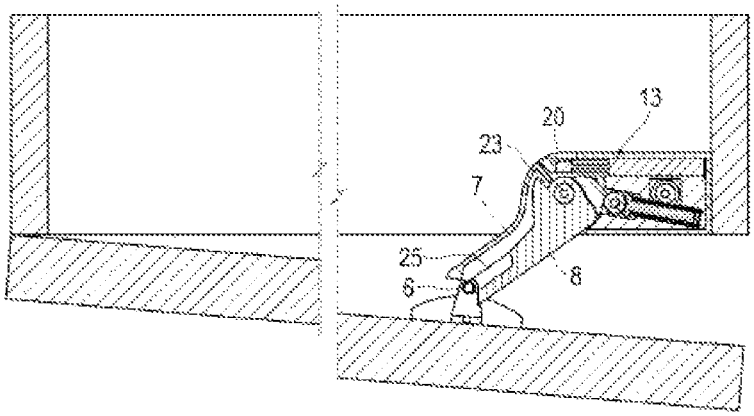

[Fig. 7]
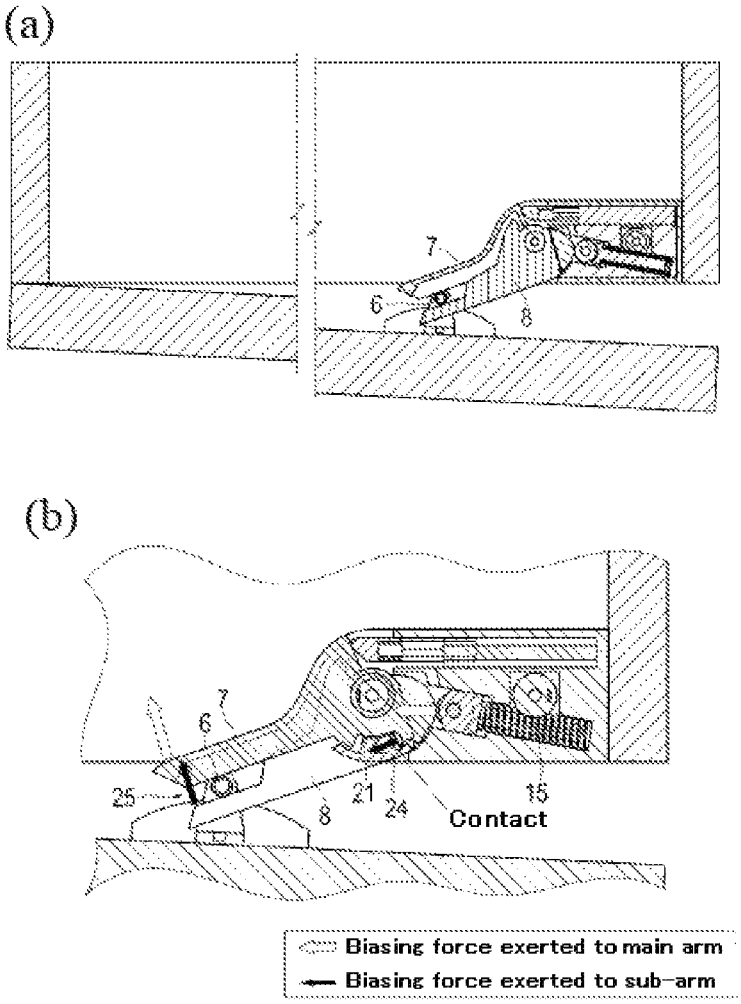

[Fig.8]
(a)
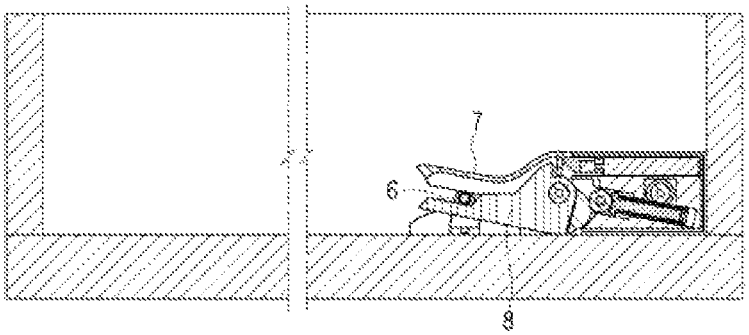
(b)
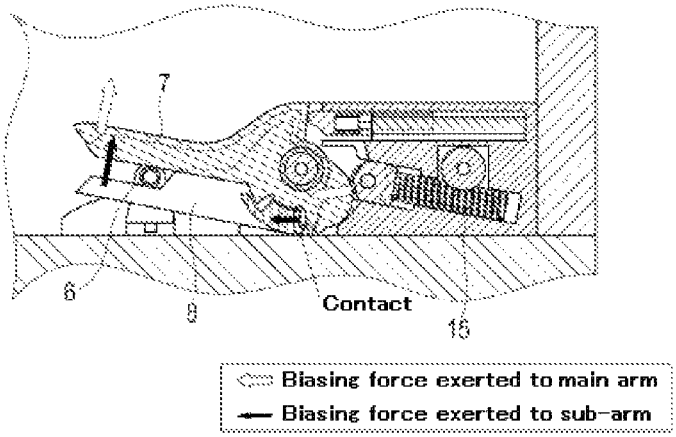

[Fig.9]
(a)
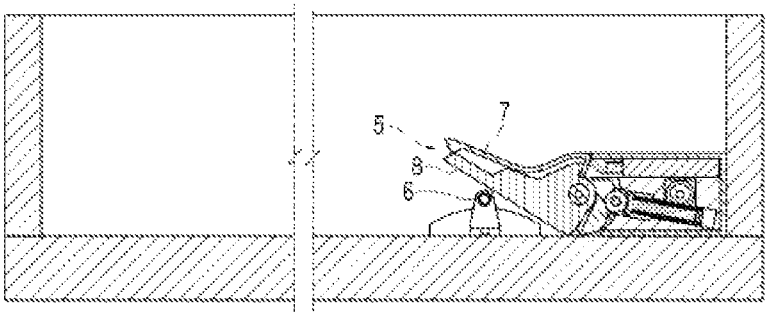
(b)
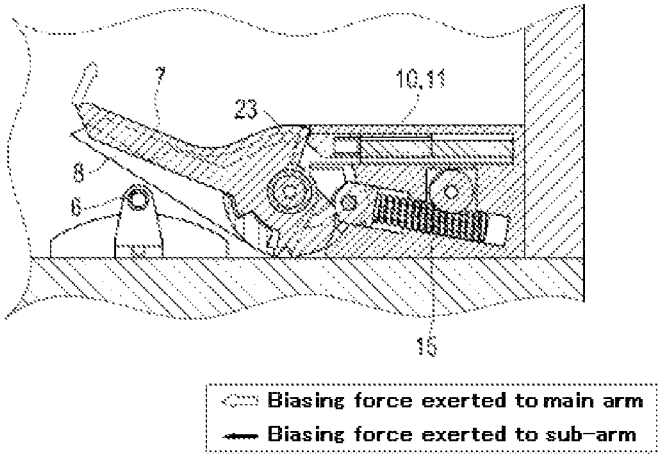

[Fig.10]
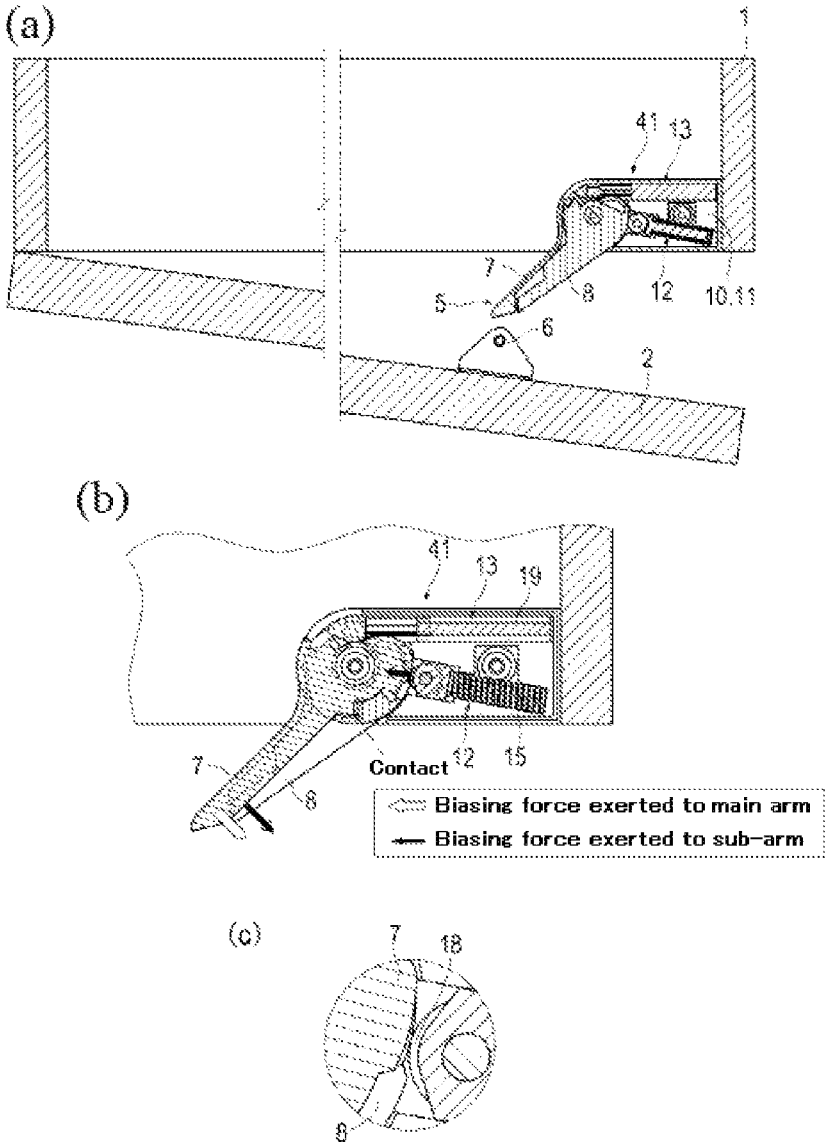

[Fig.11]
(a)
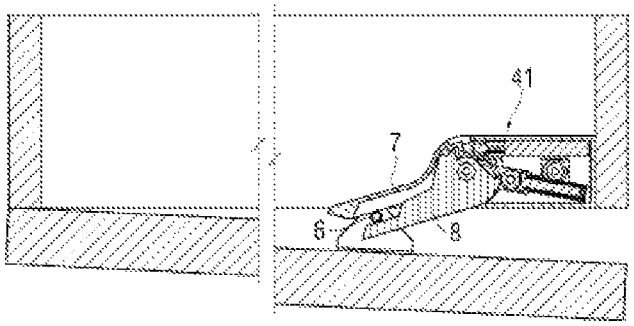
(b)
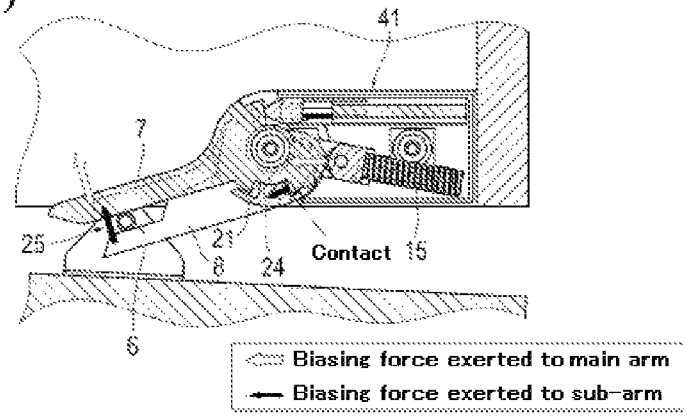
(c)
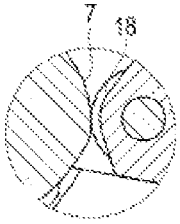

[Fig.12]
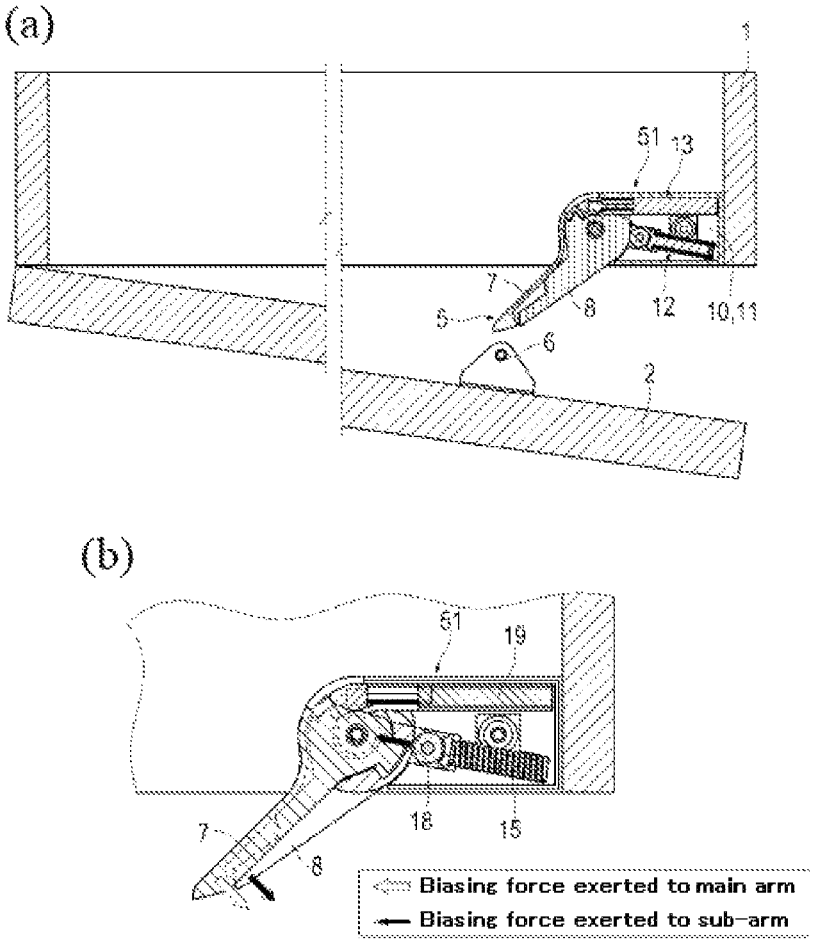

[Fig.13]
(a)
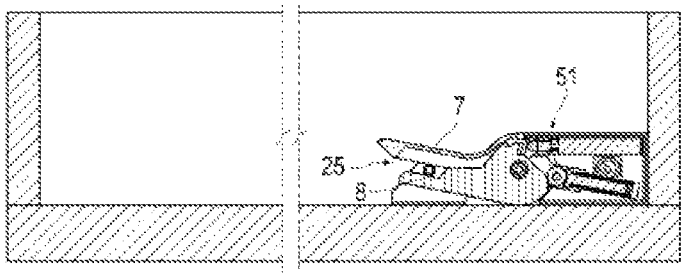
(b)
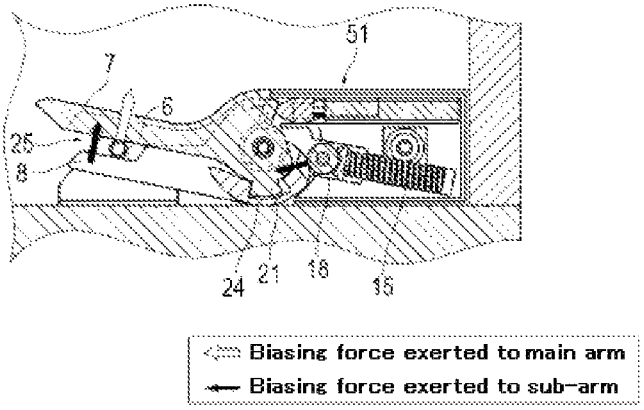

[Fig. 14]
(a)
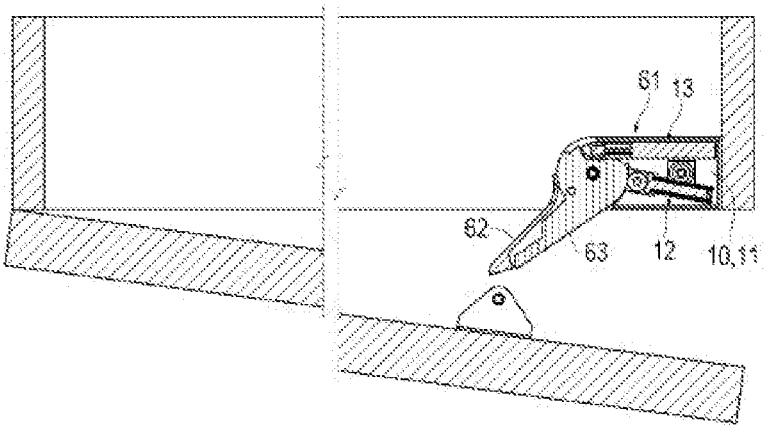
(b)
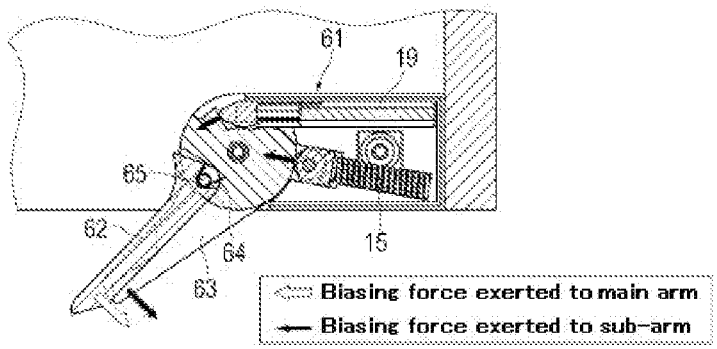

[Fig.15]
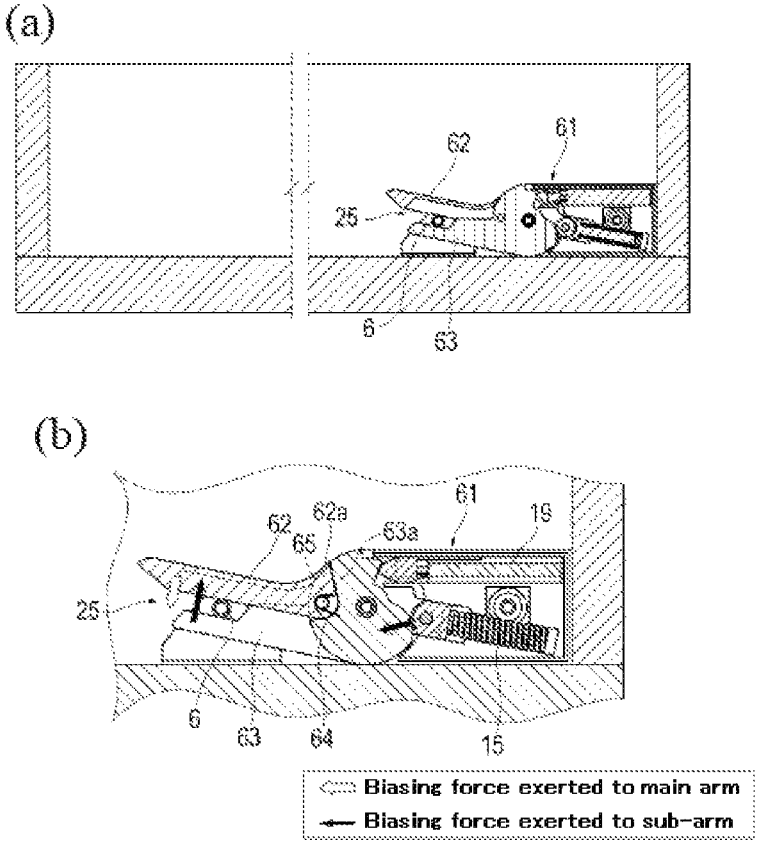

RETRACTING DEVICE AND RETRACTING DEVICE SET

RELATED APPLICATIONS

This application is the U.S. National Phase of and claims priority to International Patent Application No. PCT/JP2019/005521, International Filing Date Feb. 15, 2019 entitled RETRACTING DEVICE AND RETRACTING DEVICE SET; which claims benefit of Japanese Patent Application No. 2018-055484 filed Mar. 23, 2018; both of which are incorporated herein by reference in their entireties.

TECHNICAL FIELD

The present invention relates to a retracting device which retracts a movable body such as a door, a lid and the like, attached to a main body such as a housing, a frame and the like so as to be openable and closable to a closed position, and a retracting device set.

BACKGROUND ART

A retracting device is attached to any one of a main body and a movable body and retracts a receiving base attached to the other of the main body and the movable body. The retracting device includes an arm which rotates from a standby position to a retracting position, and a coil spring which exerts a biasing force to the arm so that the arm keeps the standby position and exerts the biasing force toward the retracting position to the arm on the side of the retracting position relative to an intermediate position between the standby position and the retracting position (see Patent document 1 and Patent document 2). When the movable body is closed, the arm in the standby position captures a receiving part of the receiving base. When the arm rotates from the standby position to the intermediate position in accordance with a closing operation of the movable body, the biasing force toward the retracting position is exerted to the arm capturing the receiving part by the coil spring, so that the movable body moves to a closed position.

In order that the arm in the standby position captures the receiving part, a groove into which the receiving part enters is formed in the arm (see Patent document 1). However, in the case where the groove is formed in the arm, if the width of the groove of the arm is widened in order to easily capture the receiving part, a gap is generated between the groove of the arm and the receiving part, so that the receiving part rattles during a process of retracting the receiving part. On the contrary, if the width of the groove of the arm is narrowed, there is fear that it becomes difficult for the arm in the standby position to capture the receiving part.

In order to solve this problem, Patent document 2 discloses the retracting device in which the arm is divided into a main arm and a sub-arm to form an acceptance portion for receiving the receiving part between the main arm and the sub-arm. In this retracting device, the main arm and the sub-arm are configured so that the acceptance portion is expanded in the standby position of the arm and the acceptance portion is narrowed in the side of the retracting position relative to the intermediate position of the arm.

PRIOR ART DOCUMENTS

Patent Documents

Patent document 1: JP 5726456 B
Patent document 2: JP 4951582 B

SUMMARY OF THE INVENTION

Problems to be Solved by the Invention

However, the retracting device described in Patent document 2 has a problem that appearance is bad since the acceptance portion between the main arm and the sub-arm is expanded in the standby position of the arm. The arm in the standby position protrudes from the retracting position and draws attention to the user.

Therefore, it is an object of the present invention to provide a retracting device which is capable of improving the appearance in the retracting device having the main arm and the sub-arm.

Means for Solving the Problems

In order to solve the above problems, one embodiment of the present invention is that a retracting device attached to any one of a main body and a movable body, in which an arm captures a receiving part of a receiving base attached to the other of the main body and the movable body to retract, so that the movable body approaches a closed position, comprising: an arm for rotating from a standby position to a retracting position; and a biasing means for exerting a biasing force to the arm so that the arm keeps the standby position and a biasing force toward the retracting position to the arm on the side of the retracting position relative to an intermediate position between the standby position and the retracting position, wherein the arm has the main arm and the sub-arm so as to form an acceptance portion for receiving the receiving part between both of them, and wherein the main arm and the sub-arm are configured so that the acceptance portion is closed or narrowed in the standby position, the receiving part comes into contact with the main arm in the standby position to expand the acceptance portion, and an end portion of the main arm and an end portion of the sub-arm come into contact with each other in a state that the acceptance portion is expanded, so that the main arm and the sub-arm rotate toward the intermediate position.

Effect of the Invention

According to the present invention, since the acceptance portion between the main arm and the sub-arm is closed or narrowed in the standby position, it is possible to improve the appearance. Further, since the receiving part comes into contact with the main arm in the standby position to expand the acceptance portion, the end portion of the main arm and the end portion of the sub-arm come into contact with each other in the state that the acceptance portion is expanded, and thus the main arm and the sub-arm rotate toward the intermediate position, it is possible to capture the receiving part in the state that the acceptance portion is expanded.

BRIEF DESCRIPTION OF THE DRAWINGS

FIG. 1 is a lower surface-side perspective view of a retracting device and a receiving base according to a first embodiment of the present invention.

FIG. 2 is an exploded perspective view of the retracting device according to the present embodiment.

FIG. 3 is an exploded perspective view of the receiving base according to the present embodiment.

FIG. 4 is horizontal cross-sectional views of the retracing device according to the present embodiment when an arm is in a standby position (FIG. 4(*a*) shows the receiving base and the retracting device, FIG. 4(*b*) is an enlarged view of the retracting device, and FIG. 4(*c*) is an enlarged view of a cam surface and a roller).

FIG. 5 is horizontal cross-sectional views of the retracting device when the arm is in the standby position (FIG. 5(*a*) is an enlarged view of the retracting device and FIG. 5(*b*) is an enlarged view of a stopper).

FIG. 6 is a horizontal cross-sectional view of the retracting device just after the receiving part comes into contact with the arm.

FIG. 7 is horizontal cross-sectional views of the retracting device when the arm is in an intermediate position (FIG. 7(*a*) shows the receiving base and the retracting device and FIG. 7(*b*) is an enlarged view of the retracting device).

FIG. 8 is horizontal cross-sectional views of the retracting device when the arm is in a retracting position (FIG. 8(*a*) shows the receiving base and the retracting device and FIG. 8(*b*) is an enlarged view of the retracting device).

FIG. 9 is horizontal cross-sectional views of the retracting device when the arm is in a retreat position (FIG. 9(*a*) shows the receiving base and the retracting device and FIG. 9(*b*) is an enlarged view of the retracting device).

FIG. 10 is horizontal cross-sectional views of a retracting device according to a second embodiment of the present invention (when the arm is in the standby position) (FIG. 10(*a*) shows the receiving base and the retracting device, FIG. 10(*b*) is an enlarged view of the retracting device and FIG. 10(*c*) is an enlarged view of the cam surface and the roller).

FIG. 11 is horizontal cross-sectional views of the retracting device according to the second embodiment of the present invention (when the arm is in the intermediate position) (FIG. 11(*a*) shows the receiving base and the retracting device, FIG. 11(*b*) is an enlarged view of the retracting device and FIG. 11(*c*) is an enlarged view of the cam surface and the roller).

FIG. 12 is horizontal cross-sectional views of a retracting device according to a third embodiment of the present invention (when the arm is in the standby position) (FIG. 12(*a*) shows the receiving base and the retracting device and FIG. 12(*b*) is an enlarged view of the retracting device).

FIG. 13 is horizontal cross-sectional views of the retracting device according to the third embodiment of the present invention (when the arm is in the retracting position) (FIG. 13(*a*) shows the receiving base and the retracting device and FIG. 13(*b*) is an enlarged view of the retracting device).

FIG. 14 is horizontal cross-sectional views of a retracting device according to a fourth embodiment of the present invention (when the arm is in the standby position) (FIG. 14(*a*) shows the receiving base and the retracting device and FIG. 14(*b*) is an enlarged view of the retracting device).

FIG. 15 is horizontal cross-sectional views of the retracting device according to the fourth embodiment of the present invention (when the arm is in the retracting position) (FIG. 15(*a*) shows the receiving base and the retracting device and FIG. 15(*b*) is an enlarged view of the retracting device).

MODE FOR CARRYING OUT THE INVENTION

Hereinafter, a retracting device of the embodiment of the present invention will be described based on the accompanying drawings. However, the retracting device of the present invention can be embodied in various embodiments, and is not limited to the embodiments described herein. This embodiment is provided with the intention to enable a person skilled in the art to fully understand the scope of the invention by making the disclosure of the specification sufficient.

First Embodiment

FIG. 1 shows a perspective view of upper parts of a frame 1 and a door 2. The door 2 as a movable body is rotatably attached to the frame 1 as a main body via hinges which are not shown in the drawings. A retracting device 4 is attached to a lower surface of the frame 1. A receiving base 9 is attached to a side surface of the door 2. If the door 2 in the opening position is closed, the arm 5 captures a receiving part 6 of the receiving base 9, and the arm 5 retracts the door 2 to a closed position.

FIG. 2 shows an exploded perspective view of the retracting device 4. 10, 11 are cases, 5 is an arm, 12 is a spring mechanism, and 13 is a damper mechanism. FIG. 1 is a lower surface-side perspective view of the retracting device 4 when the frame 1 is viewed from a back side, and FIG. 2 is a upper surface-side perspective view of the retracting device 4 when the frame 1 is viewed from a front side. Hereinafter, configurations of the cases 10, 11, the arm 5, the spring mechanism 12, and the damper mechanism 13 are described in order.

The cases 10, 11 are divided into an upper case 10 and a lower case 11. Each of the upper case 10 and the lower case 11 has a shape in which a quadrangle and a semi-circle are combined in a top view. Edges 10*a*, 11*a* are formed in quadrangle parts of the upper case 10 and the lower case 11 so that the arm 5, the spring mechanism 12 and the damper mechanism 13 can be housed between them. The edge 10*a* of the upper case 10 and the edge 11*a* of the lower case 11 are engaged with each other. No edges to allow rotation of the arm 5 are provided in circular parts of the upper case 10 and the lower case 11. The spring mechanism 12 and the damper mechanism 13 are housed in the upper case 10 and the lower case 11. A guide wall 11*b* for guiding a slider 16 of the spring mechanism 12 to linearly move is formed in the upper case 10 and the lower case 11. A guide wall 11*c* for guiding a slider 20 of the damper mechanism 13 to linearly move is formed in the upper case 10 and the lower case 11 (in FIG. 2, only the guide walls 11*b*, 11*c* of the lower case 11 are shown, but the guide walls are also formed in the upper case 10 in the same manner). The upper case 10 and the lower case 11 are connected by hooks which are not shown in drawings.

A shaft 11*d* in which the arm 5 is rotatably engaged is formed in the circular parts of the upper case 10 and the lower case 11. A through hole 11*d*1 through which a fastening member such as a screw for attaching the retracting device 4 to the frame 1 is inserted is formed in the shaft 11*d*. In the quadrangle parts of the upper case 10 and the lower case 11, a through hole 11*e* through which the fastening member such as the screw for attaching the retracting device 4 to the frame 1 is inserted, and a boss 11*f* for reinforcing the through hole 11*e* are formed (in FIG. 2, although only the shaft 11*d*, the boss 11*f* and the like of the lower case 11 are shown, the shaft and the boss are also formed to the upper case 10 in the same manner). 14 is a decorative cover for concealing the fastening member.

The arm 5 is divided into a main arm 7 and a sub-arm 8. The main arm 7 is on the side of a retracting position and the sub-arm 8 is on the side of a standby position. An acceptance portion 25 (see FIG. 6) for receiving the receiving part 6 is formed between the main arm 7 and the sub-arm 8.

As shown in FIG. 2, the main arm 7 includes a main body part 7*a* having a hole 7*a*1 engaged with the shaft 11*d* and an arm part 7*b* protruding in a radial direction from the main body part 7*a*. The main arm 7 is rotatable around the shaft 11*d*. A recessed part 7*c* with which the sub-arm 8 is engaged is formed on a side surface of the main arm 7.

An end portion 21, a cam surface 22 and a stopper 23 are formed on the main body part 7*a* of the main arm 7. The end portion 21 has a fan-shaped part 21*a* and protruding parts 21*b* projecting in the radial direction from both end parts in a circumferential direction of the fan-shaped part 21*a*. As will be described later, the sub-arm 8 is also formed with an end portion 24, and the sub-arm 8 rotates within a range of the end portion 21 with respect to the main arm 7. The cam surface 22 has a substantially circular arc shape in a top view. A roller 18 of the spring mechanism 12 comes into contact with the cam surface 22. The stopper 23 is constituted from a wall surface extending in the radial direction. The slider 20 of the damper mechanism 13 comes into contact with the stopper 23. An inclined surface 7*b*1 with which the receiving part 6 comes into contact is formed on a distal end of the arm part 7*b* of the main arm 7.

The sub-arm 8 includes a main body part 8*a* having a hole 8*a*1 engaged with the shaft 11*d* and an arm part 8*b* projecting in the radial direction from the main body part 8*a*. The sub-arm 8 is rotatable around the shaft 11*d*.

The end portion 24 is formed on the main body part 8*a* of the sub-arm 8. The end portion 24 has a shape complementary to that of the end portion 21 of the main arm 7. The end portion 24 of the sub-arm 8 has a recessed arc-shaped top portion 24*a* corresponding to the fan-shaped part 21*a* of the end portion 21 and radially extending wall portions 24*b* provided at both end parts in the circumferential direction of the top portion 24*a*. A distance in the circumferential direction of a pair of wall portions 24*b* of the end portion 24 is narrower than a distance in the circumferential direction of a pair of protruding parts 21*b* of the end portion 21. The sub-arm 8 is relatively rotatable with respect to the main arm 7 until one wall portion 24*b* comes into contact with one protruding part 21*b* and the other wall portion 24*b* comes into contact with the other protruding part 21*b*.

A stopper 26 is formed in the sub-arm 8 in conjunction with the end portion 24. The stopper 26 comes into contact with a stopper 27 of the cases 10 and 11 so as to keep the sub arm 8 in the standby position to the standby position (see FIG. 5).

As shown in FIG. 2, the spring mechanism 12 includes the slider 16, the roller 18, and a coil spring 15 as a biasing means. The slider 16 includes a u-shaped main body part 16*a* in cross-section for rotatably supporting the roller 18 via the shaft 17 and a shaft part 16*b* protruding from the main body part 16*a* to the coil spring 15. The main body part 16*a* is guided to the guide wall 11*b* of the cases 10, 11 so as to be linearly movable. The coil spring 15 is interposed between the main body part 16*a* and the cases 10, 11. The coil spring 15 biases the roller 18 supported by the main body part 16*a* to the cam surface 22 of the main arm 7.

The damper mechanism 13 includes the slider 20 and a damper 19. A distal end portion of a rod 19*b* of the damper 19 is inserted into the slider 20. The slider 20 is guided to the guide wall 11*c* of the cases 10, 11 so as to be linearly movable. The damper 19 is a linear damper. The damper 19 includes a cylinder 19*a* and the rod 19*b* which linearly moves with respect to the cylinder 19*a*. A viscous fluid is filled into the cylinder 19*a*. A piston moving in the cylinder 19*a* is provided at a base end portion of the rod 19*b*. When the rod 19*b* is linearly moved, a damper force is generated. A return spring (not shown) for biasing the rod 19*b* so as to return to a state that the rod 19*b* protrudes is provided in the cylinder 19*a*.

FIG. 3 shows an exploded perspective view of the receiving base 9. The receiving base 9 includes the receiving part 6, a bracket 31, and a position adjusting cover 32. The receiving part 6 is cylindrical and rotatably supported by a support shaft 30 fixed to the bracket 31. The bracket 31 is L-shaped. The support shaft 30 is fixed to a horizontal part 31*a* of the bracket 31. A vertical part 31*b* of the bracket 31 is fixed to the position adjusting cover 32 via a screw 33 as the fastening member. The position adjustment cover 32 includes a vertical-direction long hole 32*a* and right and left-direction long holes 32*b*. The position adjusting cover 32 is attached to the door 2 so that the position in the right and left direction can be adjusted through the right and left-directional long holes 32*b*. The bracket 31 is attached to the position adjustment cover 32 so that the position in the vertical direction can be adjusted through the vertical-direction long hole 32*a*. The receiving part 6 can be adjusted the positions in the right and left direction and the vertical direction with respect to the door 2.

The operation of the retracting device 4 according to the present embodiment is described with reference to FIGS. 4 to 9. FIG. 4 shows horizontal cross-sectional views of the retracting device 4 in which the arm 5 is in the standby position. FIG. 4(*a*) shows the receiving part 6 and the retracting device 4, FIG. 4(*b*) shows the enlarged view of the retracting device 4, and FIG. 4(*c*) shows the enlarged view of the cam surface 22 and the roller 18.

As shown in FIG. 4(*b*), in the standby position of the arm 5, the acceptance portion 25 between the main arm 7 and the sub-arm 8 is closed. That is, the acceptance portion 25 is not formed between the main arm 7 and the sub-arm 8. Instead of that the acceptance portion 25 is closed, the acceptance portion 25 in the standby position may be narrower than the acceptance portion 25 (see FIG. 7(*b*)) in a state that the main arm 7 and the sub-arm 8 capture the receiving part 6. In the standby position of the arm 5, as shown in FIG. 4(*c*), the roller 18 comes into contact with the vicinity of a partial recess 22*a* of the cam surface 22 of the main arm 7. A biasing force toward the shaft 11*d* shown by the white arrow in FIG. 4(*b*), that is, the biasing force for keeping the main arm 7 in the standby position is exerted to the main arm 7 by the coil spring 15.

On the other hand, the biasing force is not exerted to the sub-arm 8. As shown in FIG. 5(*a*), the end portion 24 of the sub-arm 8 comes into contact with the end portion 21 of the main arm 7, and as shown in FIG. 5(*b*), the stopper 26 of the sub-arm 8 comes into contact with the stopper 27 of the cases 10, 11, so that the sub-arm 8 is kept in the standby position. The biasing force in the standby direction (a counterclockwise direction in FIG. 4(*b*)) is exerted to the main arm 7 in the standby position, and the biasing force in the standby direction is transmitted from the main arm 7 to the sub-arm 8, whereby the main arm 7 and the sub-arm 8 can be kept at the standby position.

As shown in FIG. 6, when the door 2 is closed, the receiving part 6 comes into contact with the main arm 7 in the standby position and the main arm 7 is rotated to expand the acceptance portion 25. Then, the receiving part 6 enters the expanded acceptance portion 25. The end portion 21 of the main arm 7 (see FIG. 2) and the end portion 24 of the sub-arm 8 (see FIG. 2) come into contact with each other in the state that the acceptance portion 25 is expand, and the main arm 7 and the sub-arm 8 rotate toward the intermediate position. The stopper 23 of the main arm 7 comes into contact with the slider 20 of the damper mechanism 13 to generate the damper force.

If the main arm 7 exceeds the intermediate position (dead center) shown in FIG. 7(*b*), the biasing force toward the retracting position shown by the white arrow in FIG. 7(*b*) is exerted to the main arm 7. The end portion 21 of the main arm 7 and the end portion 24 of the sub-arm 8 are in contact with each other in a portion surrounding by the ellipse, and the biasing force to the retracting position shown by the arrow filled in FIG. 7(*b*) is transmitted from the main arm 7 to the sub-arm 8.

As shown in FIG. 8(*b*), the biasing forces exerted on the main arm 7 and the sub-arm 8 continue until the door 2 is closed, that is, until the main arm 7 and the sub-arm 8 reach the retracting position. In the retracting position shown in FIG. 8(*b*), the biasing force in the retracting direction (a clockwise direction in FIG. 8(*b*)) shown by the white arrow in FIG. 8(*b*) is exerted to the main arm 7 by the coil spring 15 so as to keep the state that the door 2 is closed. The biasing force in the retracting direction shown by the arrow filled in FIG. 8(*b*) is transmitted from the main arm 7 to the sub-arm 8.

FIG. 9 shows the arm 5 in a retreat position. When the arm 5 in a state that the receiving part 6 is not captured by a malfunction is in the retreat position, if the door 2 is closed, the receiving part 6 comes in contact with the sub-arm 8, thereby the arm 5 rotates in the retracting direction (a clockwise direction in FIG. 9) from the retracting position shown in FIG. 8 to the retreat position shown in FIG. 9. As shown in FIG. 9(*b*), in the retreat position, the biasing force in the retracting direction (the clockwise direction in FIG. 9(*b*)) shown by the white arrow in FIG. 9(*b*) is exerted to the main arm 7 by the coil spring 15. The biasing force is not exerted to the sub-arm 8. The stopper 23 of the main arm 7 comes into contact with the cases 10, 11, and rotation in the retracting direction of the main arm 7 is restricted.

Second Embodiment

FIGS. 10 and 11 show a retracting device 41 according to a second embodiment of the present invention. Similarly the first embodiment, the retracting device 41 of the second embodiment includes the cases 10, 11, the arm 5, the spring mechanism 12, and the damper mechanism 13. The acceptance portion 25 (see FIG. 11(*b*)) for receiving the receiving part 6 is formed between the main arm 7 and the sub-arm 8. Since the configurations of the main arm 7, the sub-arm 8, the spring mechanism 12, and the damper mechanism 13 are substantially the same as those of the first embodiment, the same reference numerals are given to the components and the description thereof is omitted.

As shown in FIG. 10, similarly the first embodiment, the acceptance portion 25 of the second embodiment is closed in the standby position. As shown in FIG. 11, the receiving part 6 comes into contact with the main arm 7 in the standby position, so that the acceptance portion 25 is expanded. In a state that the acceptance portion 25 is expanded, the end portion 21 of the main arm 7 and the end portion 24 of the sub-arm 8 come into contact with each other (contacting part is surrounded by an ellipse), so that the main arm 7 and the sub-arm 8 rotate toward the intermediate position.

However, in the second embodiment, unlike the first embodiment, as shown in FIG. 10(*c*), the roller 18 comes into contact with the sub-arm 8 in the standby position. Then, as shown in FIG. 10(*b*), the coil spring 15 as the biasing means exerts the biasing force shown by the arrow filled in the figure so as to keep the standby position to the sub-arm 8 in the standby position. Further, as shown in FIG. 10(*b*), a coil spring (not shown) in the damper 19 as the biasing means exerts the biasing force colored in white in the figure so as to keep the standby position to the main arm 7 in the standby position.

As shown in FIG. 11(*b*), on the side of the retracting position relative to the intermediate position of the main arm 7, the biasing force shown by the white arrow in the figure, which is directed to the retracting position by the coil spring 15, is exerted to the main arm. The contact of the roller 18 is switched from the sub-arm 8 to the main arm 7. The end portion 21 of the main arm 7 and the end portion 24 of the sub-arm 8 are in contact with each other, and the biasing force shown by the arrow filled in the figure, which is directed from the main arm 7 to the retracting position, is transmitted to the sub-arm 8. The biasing forces exerted on the main arm 7 and the sub-arm 8 continue until the door 2 is closed.

Third Embodiment

FIGS. 12 and 13 show a retracting device 51 according to a third embodiment of the present invention. Similarly the first embodiment, the retracting device 51 of the third embodiment also includes the cases 10, 11, the arm 5, the spring mechanism 12, and the damper mechanism 13. The acceptance portion 25 (see FIG. 13) for receiving the receiving part 6 is formed between the main arm 7 and the sub-arm 8. Since the configurations of the main arm 7, the sub-arm 8, the spring mechanism 12, and the damper mechanism 13 are substantially the same as those of the first embodiment, the same reference numerals are given to the components and the description thereof is omitted.

In the third embodiment, as the first embodiment, the acceptance portion 25 is closed in the standby position as shown in FIG. 12(*b*). As shown in FIG. 13(*b*), the receiving part 6 comes into contact with the main arm 7 in the standby position, so that the acceptance portion 25 is expanded. In such a state that the acceptance portion 25 is expanded, the end portion 21 of the main arm 7 and the end portion 24 of the sub-arm 8 come into contact with each other, so that the main arm 7 and the sub-arm 8 rotate together toward the intermediate position (FIG. 13(*b*) shows the retracting position, but is the same in the intermediate position).

However, in the third embodiment, unlike the first embodiment, as shown in FIG. 12(*b*), the roller 18 comes into contact with the sub-arm 8 in the standby position. The coil spring 15 as the biasing means exerts the biasing force shown by the arrow filled in the figure so as to keep the standby position to the sub-arm 8 in the standby position. The coil spring (not shown) in the damper 19 as the biasing means exerts the biasing force shown by the white arrow in the figure so as to keep the standby position to the main arm 7 in the standby position.

As shown in FIG. 13(*b*), on the side of the retracting position relative to the intermediate position of the sub-arm 8, the biasing force shown by the arrow filled in the figure, which is directed to the retracting position by the coil spring 15, is exerted to the sub-arm 8. The roller 18 comes into contact with only the sub-arm 8. The biasing force shown by the white arrow in the figure, which is directed from the sub-arm 8 to the retracting position through the receiving part 6, is transmitted to the main arm 7. The biasing forces exerted on the main arm 7 and the sub-arm 8 continue until the door 2 is closed.

Fourth Embodiment

FIGS. 14 and 15 show a retracting device 61 according to a fourth embodiment of the present invention. Similarly the first embodiment, the retracting device 61 of the fourth embodiment also includes the cases 10, 11, the arm, the spring mechanism 12, and the damper mechanism 13. Since the configurations of the spring mechanism 12 and the damper mechanism 13 are substantially the same as those of the first embodiment, the same reference numerals are given to the components and the description thereof is omitted.

As shown in FIG. 14(*b*), in the fourth embodiment, the main arm 62 is rotatably supported by the sub-arm 63 via a shaft 65. The acceptance portion 25 (see FIG. 15(*b*)) for receiving the receiving part 6 is formed between the main arm 62 and the sub-arm 63. A torsion spring 64 as the biasing means is bridged on the main arm 62 and the sub-arm 63 so that the acceptance portion 25 is closed.

In the fourth embodiment, as the first embodiment, the acceptance portion 25 is closed in the standby position as shown in FIG. 14(*b*). As shown in FIG. 15(*b*), the receiving part 6 comes into contact with the main arm 62 in the standby position, so that the acceptance portion 25 is expanded. In the state that the acceptance portion 5 is expanded, the end portion 62*a* of the main arm 62 and the end portion 63*a* of the sub-arm 63 come into contact with each other, so that the main arm 62 and the sub-arm 63 rotate toward the intermediate position (FIG. 15(*b*) shows the retracting position, but is the same as the intermediate position).

However, in the fourth embodiment, unlike the first embodiment, as shown in FIG. 14(*b*), the coil spring 15 as the biasing means and the coil spring (not shown) in the damper 19 exert the biasing force shown by the arrow filled in the figure so as to keep the standby position to the sub-arm 63 in the standby position. Further, the torsion spring 64 as the biasing means exerts the biasing force shown by the white arrow in the figure so that the main arm 62 in the standby position keeps the standby position.

As shown in FIG. 15(*b*), on the side of the retracting position relative to the intermediate position of the sub-arm 63, the biasing force shown by the arrow filled in the figure, which is directed to the retracting position by the coil spring 15, is exerted to the sub-arm 63.

The present invention is not limited to the above embodiment, and various embodiments can be modified without changing the scope of the present invention.

In the above embodiment, the retracting device is attached to the frame and the receiving base is attached to the door. However, the receiving base may be attached to the frame and the retracting device may be attached to the door.

In the above embodiment, the acceptance portion is closed in the standby position of the arm, but the acceptance portion may be narrowed in the standby position of the arm.

Each of the configurations of the cases, the arm, the spring mechanism, and the damper mechanism of the above embodiments is an example, and other configurations can be adopted without changing the scope of the present invention.

This specification is based on Japanese patent application No. 2018-055484 filed on Mar. 23, 2018. All the contents are incorporated herein.

EXPLANATION OF REFERENCE NUMERAL

1 Frame (Main body)
2 Door (Movable body)
4 Retracting device
5 Arm
6 Receiving part
7 Main arm
8 Sub-arm
9 Receiving base
15 Coil spring (Biasing means)
18 Roller
19 Damper (Biasing means)
21 End portion of main arm
22 Cam surface
24 End portion of sub-arm
25 Acceptance portion
41 Retracting device
51 Retracting device
61 Retracting device
62 Main arm
63 Sub-arm
62*a* End portion of main arm
63*a* End portion of sub-arm

What is claimed is:

1. A retracting device attached to any one of a main body and a movable body, in which an arm captures a receiving part of a receiving base attached to the other of the main body and the movable body to retract, so that the movable body approaches a closed position, comprising:

an arm for rotating from a standby position to a retracting position; and a biasing means for exerting a biasing force to the arm so that the arm keeps the standby position and a biasing force toward the retracting position to the arm on a side of the retracting position relative to an intermediate position between the standby position and the retracting position, wherein the arm has a main arm and a sub-arm so as to form an acceptance portion for receiving the receiving part between said main arm and said sub-arm, and wherein the main arm and the sub-arm are configured so that the acceptance portion is closed or narrowed in the standby position, the receiving part comes into contact with the main arm in the standby position to expand the acceptance portion, and an end portion of the main arm and an end portion of the sub-arm come into contact with each other in a state that the acceptance portion is expanded, so that the main arm and the sub-arm rotate toward the intermediate position.

2. The retracting device claimed in claim 1, wherein the biasing means is provided with a coil spring which exerts the biasing force to the main arm so that the main arm in the standby position keeps the standby position, and wherein the coil spring exerts the biasing force toward the retracting position to the main arm and transmits the biasing force from the main arm toward the retracting position to the sub-arm, on the side of the retracting position relative to the intermediate position.

3. The retracting device claimed in claim 2, wherein the coil spring presses a roller in contact with a cam surface of the main arm.

4. The retracting device claimed in claim 1, wherein when the arm in a state of not capturing the receiving part by a malfunction is in the retracting position, the receiving part comes into contact with the sub-arm of the arm, and the arm rotates from the retracting position to a retreat position.

5. A retracting device set:

the retracting device claimed in claim 1; and a receiving base attached to the other of the main body and the movable body.

* * * * *